US007578253B2

(12) United States Patent
Mortensen

(10) Patent No.: US 7,578,253 B2
(45) Date of Patent: Aug. 25, 2009

(54) WATER SKIMMER

(75) Inventor: Karl Mortensen, Wakefield, RI (US)

(73) Assignee: Water Skimmer Boats LLC, Wakefield, RI (US)

( * ) Notice: Subject to any disclaimer, the term of this patent is extended or adjusted under 35 U.S.C. 154(b) by 0 days.

(21) Appl. No.: 11/984,945

(22) Filed: Nov. 26, 2007

(65) Prior Publication Data

US 2009/0133614 A1 May 28, 2009

(51) Int. Cl.
*B63B 1/20* (2006.01)

(52) U.S. Cl. ..... 114/283; 114/288

(58) Field of Classification Search ..... 114/61.1, 114/61.33, 283, 288, 291, 292
See application file for complete search history.

(56) References Cited

U.S. PATENT DOCUMENTS

| | | | | |
|---|---|---|---|---|
| 1,169,947 | A | 2/1916 | Forse | |
| 1,712,281 | A | 5/1929 | Royer | |
| 2,126,304 | A * | 8/1938 | Apel et al. | 114/288 |
| 2,757,629 | A | 8/1956 | Wiltse | |
| 2,900,945 | A | 8/1959 | Canazzi | |
| 2,989,939 | A * | 6/1961 | Tatter | 114/61.33 |
| 3,051,115 | A | 8/1962 | Canazzi | |
| 3,075,488 | A * | 1/1963 | Wolfe et al. | 114/288 |
| 3,126,856 | A | 3/1964 | Fuller | |
| 3,177,836 | A | 4/1965 | Salamin | |
| 3,239,856 | A | 3/1966 | Stocking | |
| 3,469,549 | A | 9/1969 | Rae | |
| 3,625,173 | A | 12/1971 | Milton | |
| 3,807,337 | A * | 4/1974 | English et al. | 114/61.33 |
| 3,885,514 | A | 5/1975 | Lauenborg | |
| 3,930,455 | A | 1/1976 | Bremer | |
| 3,967,571 | A | 7/1976 | Mut | |
| 3,996,869 | A | 12/1976 | Hadley | |
| 4,862,817 | A | 9/1989 | Hornsby, Jr. et al. | |
| 4,944,240 | A * | 7/1990 | Morris | 114/283 |
| 5,140,930 | A | 8/1992 | Lund | |
| 5,544,609 | A | 8/1996 | Miller | |

* cited by examiner

*Primary Examiner*—Lars A Olson
(74) *Attorney, Agent, or Firm*—Michael de Angeli

(57) ABSTRACT

A small outboard motor powered boat comprises a hull undersurface that defines a generally flat central section, with two generally parallel-sided pontoons extending rearwardly from an upturned bow to a point about half the length of the hull aft. A stern rake section begins at a transverse line near the transom of the hull and forms a downward angle with respect to the flat central section. At speed, air is entrained between the pontoons, providing lift to the bow of the vessel, while the after portion is supported by the stern rake section. Thus, the vessel effectively rides on the pontoons and the stern rake section, reducing wetted surface and thus improving efficiency. The downwardly-extending lengthwise sides of the pontoons provide lateral surface, providing good steering characteristics.

21 Claims, 9 Drawing Sheets

(A)

(B)

WATER SKIMMER

FIELD OF THE INVENTION

This invention is of a small, outboard motor powered runabout boat.

BACKGROUND OF THE INVENTION

There is of course a great deal of prior art in the field of boat hull design, and various of the specific attributes of the hull design of the present invention are shown or suggested in various prior patents. Exemplary patents include the following:

Rae U.S. Pat. No. 3,469,549
Forse U.S. Pat. No. 1,169,947
Milton U.S. Pat. No. 3,625,173
Royer U.S. Pat. No. 1,712,281
Wiltse U.S. Pat. No. 2,757,629
Canazzi U.S. Pat. Nos. 2,900,945 and 3,051,115
Fuller U.S. Pat. No. 3,126,856
Salamin U.S. Pat. No. 3,177,836
Stocking U.S. Pat. No. 3,239,856
Lauenborg U.S. Pat. No. 3,885,514
Bremer U.S. Pat. No. 3,930,455
Mut U.S. Pat. No. 3,967,571
Hadley U.S. Pat. No. 3,996,869
Hornsby U.S. Pat. No. 4,862,817
Lund U.S. Pat. No. 5,140,930
Miller U.S. Pat. No. 5,544,609

Nonetheless, as will appear below, the boat hull design of the present invention, particularly as defined by the appended claims, differs significantly and unobviously from the prior art of which the inventor is aware.

OBJECTS AND SUMMARY OF THE INVENTION

The boat hull of the present invention, referred to sometimes herein as the Water Skimmer design, is of a small, lightweight pleasure craft, not intended to carry heavy loads or more than two crew, nor intended for rough water, but intended to provide high speed responsive to relatively low power, so as to provide fuel efficiency, and to provide safe and stable handling characteristics, all so as to provide an exciting ride while not requiring extraordinary operator skill.

These objectives are met by the present design. Some of the important aspects of the design are the provision of a hull undersurface that defines a generally flat central section, with two generally parallel-sided pontoons extending rearwardly from an upturned bow to a point about half the length of the hull aft. A stern rake section begins at a transverse line near the transom of the hull and forms a downward angle with respect to the flat central section. At speed, air is entrained between the pontoons, providing lift to the bow of the vessel, while the after portion is supported by the stern rake section. Thus, the vessel effectively rides on the pontoons and the stern rake section, reducing wetted surface and thus improving efficiency. The downwardly-extending lengthwise sides of the pontoons provide lateral surface, providing good steering characteristics.

BRIEF DESCRIPTION OF THE DRAWINGS

The invention will be better understood if reference is made to the accompanying drawings, in which.

DESCRIPTION OF THE PREFERRED EMBODIMENTS

Figure 1:
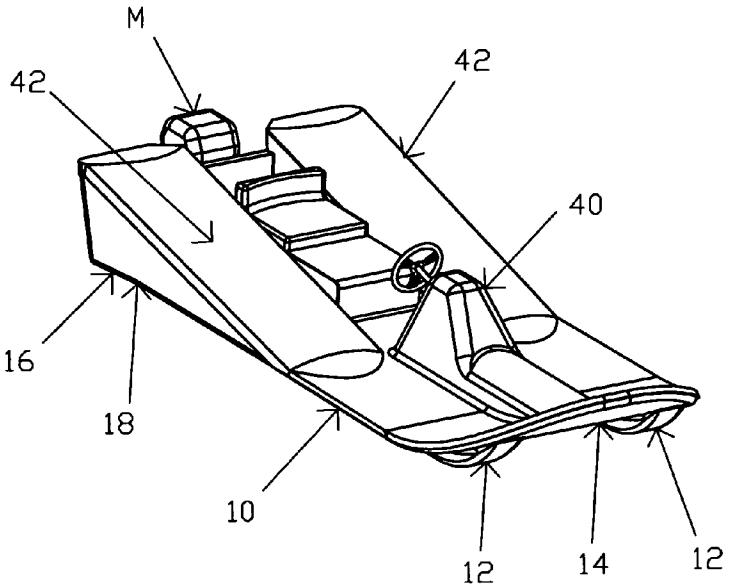
FIG. 1 shows a perspective view of the vessel of the invention from the starboard forward quarter.

As discussed briefly above, many of the important features of the hull of the invention are embodied in the undersurface of the hull, that is, the surface at which the boat meets the water. The hull is symmetric about a longitudinal centerline. As shown in the Figures, the undersurface comprises a generally planar central portion 10, port and starboard pontoons 12, an upturned bow section 14, and a generally planar stern rake section 16 that meets the central portion at a line 18 and forms an angle with respect thereto. The after end of stern rake section 16 meets the transom 20, which itself comprises generally planar port and starboard laterally outer portions 22 and 24, and a recessed central portion or "motor notch" 26, to which a conventional outboard motor M may be attached in the usual manner. The laterally inward sides of outer portions 22 and 24 of transom 20 are angled at on the order of 45 degrees, as illustrated, so as to provide clearance for the motor M to be pivoted to turn the vessel.

The fact that the transom is thus "notched" to receive the motor means that the stern rake section meets the notch 26 along a line 16*a* (see FIG. 6) that is a few inches forward of the lines 16*b* at which it intersects the outer portions 22 and 24 of the transom 20. (Key dimensions of the hull are specified below.) As will appear more fully below, at speed the aero- and hydrodynamic characteristics of the hull are such that the boat effectively balances on line 16*a*.

As illustrated, pontoons 12 are generally parallel to one another and have parallel lateral surfaces, so as to be of consistent cross-sectional shape from front to rear, and are inset substantially from the outer periphery of the hull, so that the undersurface of the planar section 10 and upturned bow section 14 meet the pontoons 12 so as to define longitudinally-extending spaces 28. These are of significance in the handling of the vessel at speed, as will be explained further below. In a currently-preferred embodiment, where the vessel is 118 inches long overall, the pontoons are 6¼ inches wide where they intersect the planar central portion 10 of the undersurface of the boat, are 3 inches deep, and are inset by 7¾ inches from the outer edges of the hull.

Figure 7:
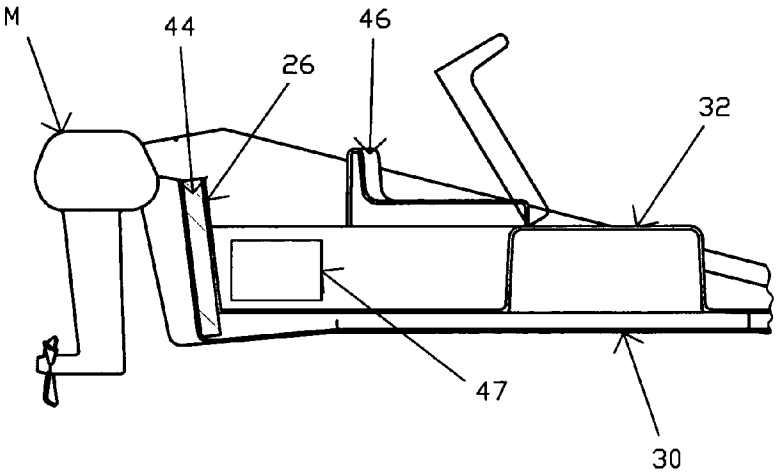
FIG. 7 is a partial crossectional view of the vessel illustrating one preferred manner of construction.
Figure 8:
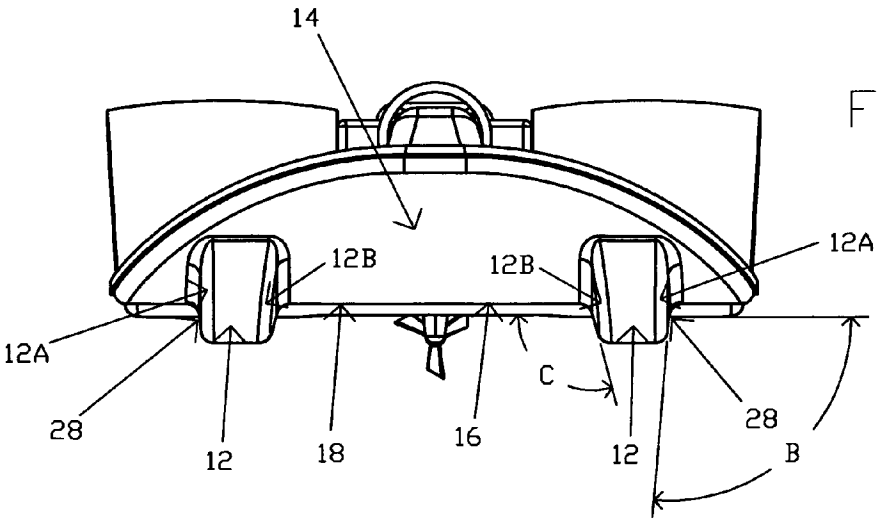
FIG. 8 shows a bow-on view of the vessel.

It will also be observed that the pontoons 12 are wider at their intersections with the generally planar center section 10 and the upturned bow section 14 than at their lower extremities. More specifically, the laterally-outer downwardly-extending surfaces 12*a* of the pontoons 12 intersect the undersurface of the planar section 10 and upturned bow section 14 at an angle B (see FIG. 8) that is slightly greater than 90 degrees, typically 95 degrees. This is essentially to enable manufacture; that is, it is anticipated that the hull will be molded in upper and lower portions 30 and 32, as shown by FIG. 7, and some "draft" is required so that the lower portion 32, in which the pontoons will be integrally molded, can be freed readily from the mold. By comparison, the laterally-inner downwardly-extending surfaces 12*b* of the pontoons 12 intersect the undersurface of the planar section 10 and upturned bow section 14 at an angle C that is significantly greater than 90 degrees, typically 105 degrees; this is done to optimize the boat's handling characteristics, as discussed further below. The after ends of the pontoons may typically form an angle E (see FIG. 5) of 105 degrees with respect to the planar central surface 10.

It will be further observed that the pontoons 12 are curved upwardly at their forward extremities, so as to conform to the undersurface of the upturned bow section 14; this is done so that the forward ends of the pontoons do not present a transverse flat surface to the water. It will be appreciated that the forward extremities of the pontoons might alternatively be rounded or pointed. In the embodiment shown, the forward extremities of the pontoons essentially coincide with the outer edge of the bow section 14, but the invention is not to be thus limited.

The length of the pontoons relative to the overall length of the boat is also considered to be of significance to the performance of the boat, for reasons discussed further below. If a longitudinal dimension A (see FIG. 5) of the boat is measured between the forward ends of the pontoons 12 and the aftermost portion of the transom (A being 112 inches in the presently preferred embodiment), the length D of the pontoons is approximately one-half A; D is 55 inches in the current embodiment.

Figure 5:
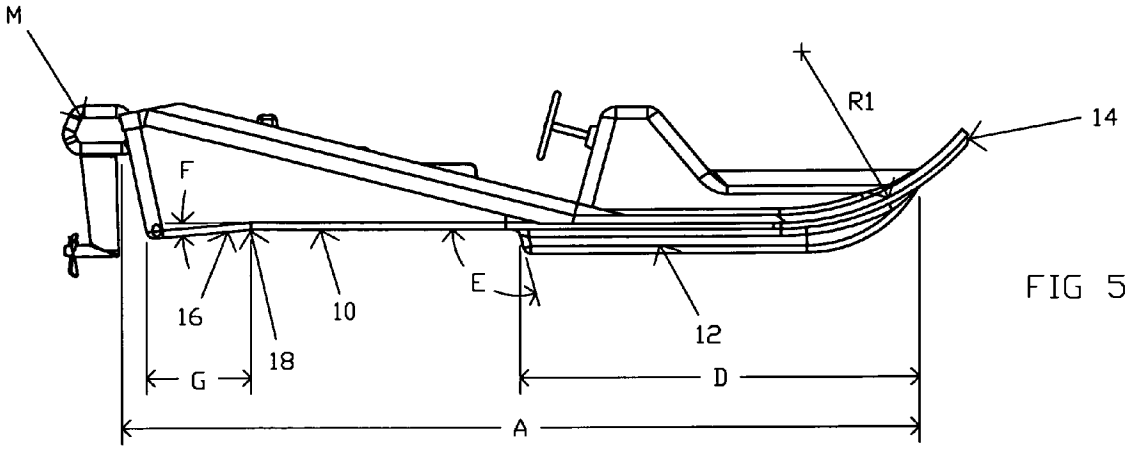
FIG. 5 shows a side view of the vessel, from the starboard side.
Figure 6:
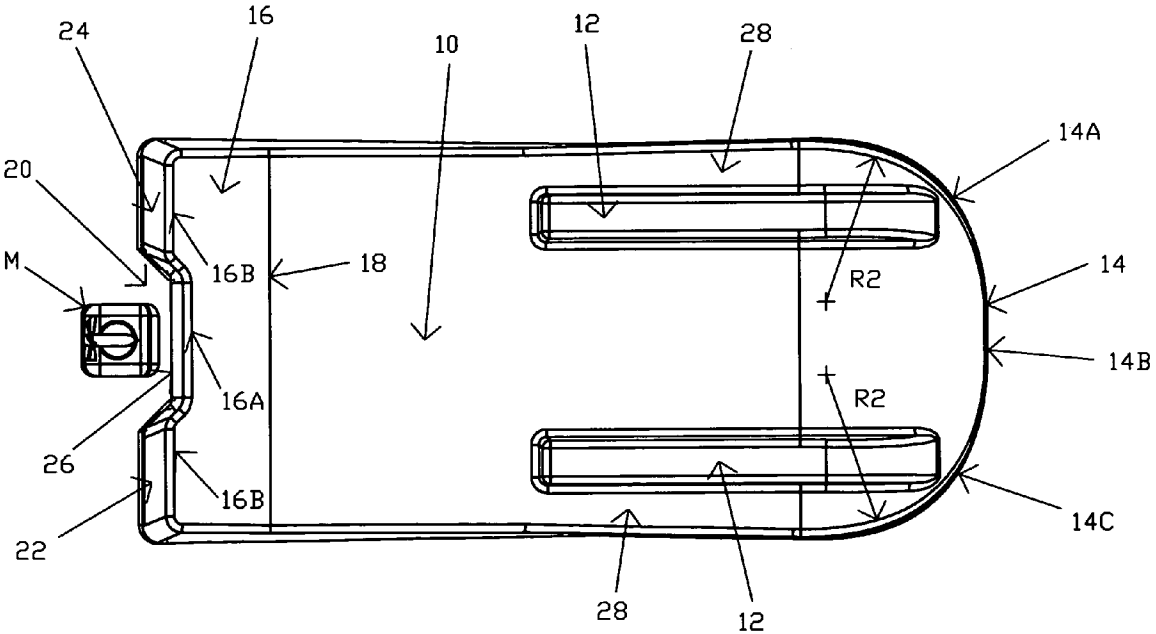
FIG. 6 shows a view of the vessel from beneath.

In the preferred embodiment, the upturned bow section 14 forms a section of a cylinder in side view, as if the flat central portion of the undersurface of the hull were simply bent around a central point at a single radius R1 (31½ inches to the outer surface, in the current embodiment), as shown in FIG. 5. In plan, as shown in FIG. 6, the outline of the bow section also comprises circular sections 14*a* described by a radius R2 (22½ inches to the outer surface, in the current embodiment), and connected by a short (6¾ inches in the current embodiment) straight section 14*b*. Again, the invention is not to be limited strictly to this precise configuration.

As discussed briefly above, the stern rake section 16 commences at a transverse line 18 and forms a slight angle downwardly toward the transom with respect to the planar central portion 10. In the currently-preferred embodiment, this angle F (see FIG. 5) is four degrees, and dimension G, the distance between the lowermost portion of the outer portions 22 and 24 of the transom 20 and transverse line 18, is 17½ inches, that is, approximately 16% of A.

As noted, the transom of the boat comprises generally planar port and starboard laterally outer portions 22 and 24, and a recessed central portion or "motor notch" 26, to which a conventional outboard motor M may be attached in the usual manner. The central portion 26 makes an angle of 7 degrees with respect to a plane perpendicular to that of the central section 10, which, in use, is essentially parallel to the water surface. (It is conventional to mount outboard motors on transoms making an angle of 7 degrees to the water surface.) The laterally outer portions 22 and 24 may make a larger angle, typically 12 degrees, with respect to the same plane, largely for aesthetic reasons.

The superstructure of the vessel of the invention essentially comprises a central steering station 40 to which are mounted conventional steering and engine controls. The operator sits behind and straddles the steering station 40. A second rider may sit behind and straddle the operator. On either side of the steering station there are provided flotation compartments 42.

As mentioned above, and illustrated in FIG. 7, it is envisioned that the vessel of the invention can be manufactured by molding an upper portion 32 and a lower portion 30 of fiberglass or the like, and adhesively bonding these portions to one another along the outer edge of the hull, and possibly also at intermediate points. The volume between the upper and lower portions, particularly the interior volumes of flotation compartments 42, can be filled with injectable, hardening foam to strengthen the hull and render it unsinkable. As shown a wooden plank 44 can be encapsulated in the central portion 26 of the transom, to strengthen the hull in the area of motor attachment. As further indicated, a passenger seat 46, also molded of fiberglass or the like, can be hinged at a forward edge, providing access to a compartment beneath that is convenient for placement of the fuel tank 47.

Figure 2:
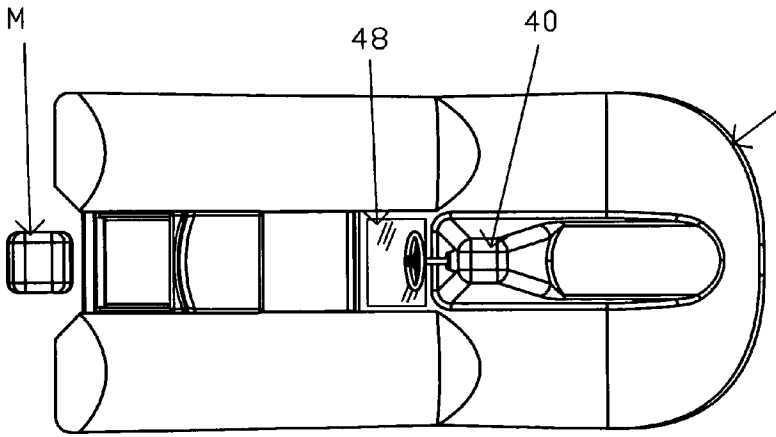
FIG. 2 shows a plan view of the vessel.
Figure 3:
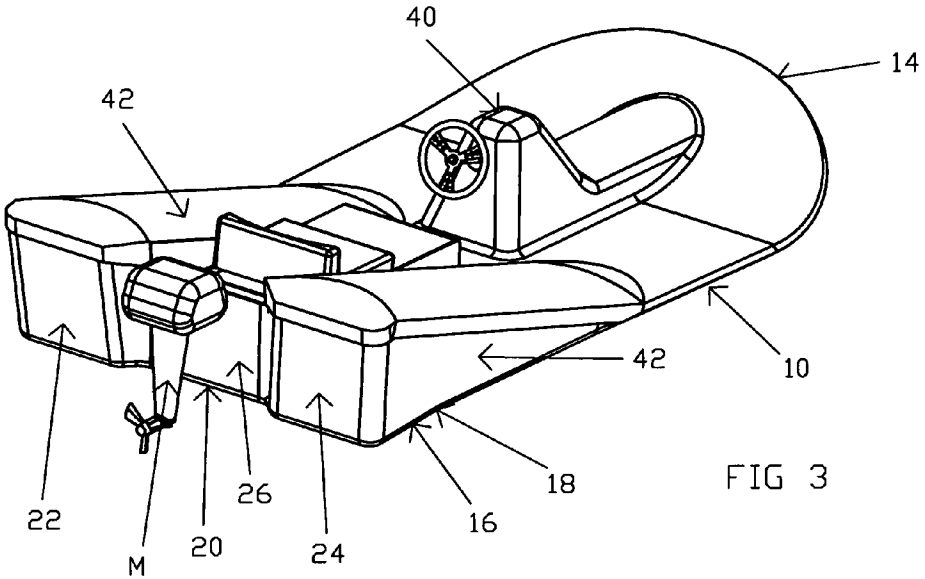
FIG. 3 shows a perspective view of the vessel of the invention from the starboard aft quarter.
Figure 4:
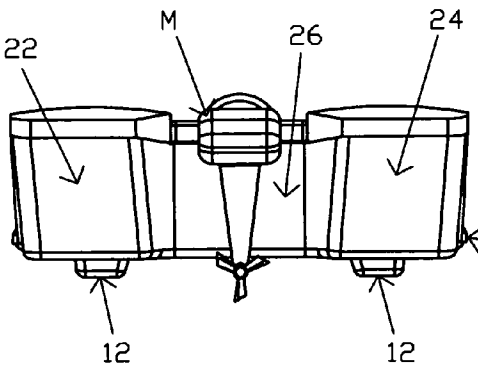
FIG. 4 shows a rear view of the vessel.

A section of the molded central section 10 can be replaced with a transparent panel 48 (FIG. 2), providing a "glass-bottom boat" effect, i.e., allowing the operator to see into the water beneath the craft.

Having thus described the design features of the vessel of the invention we turn to description of its operational characteristics, as explained with reference to FIGS. 9-13.

Figure 9:
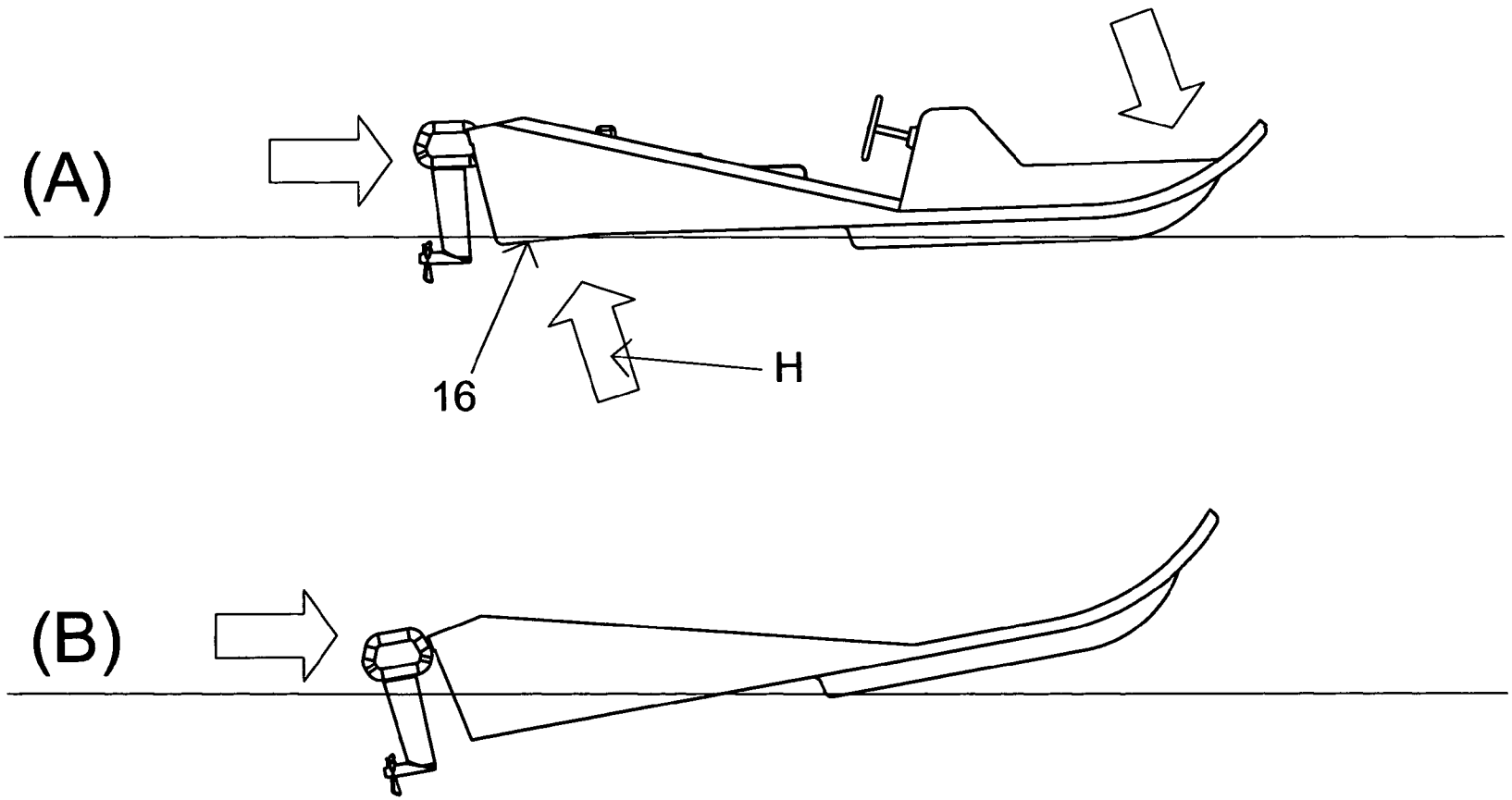
FIGS. 9-13 are views illustrating various characteristics of the vessel in use.

FIG. 9 contrasts the attitude of the vessel of the invention in FIG. 9(*a*) during acceleration from rest with that of a similar hull lacking the stern rake section in FIG. 9(*b*). As illustrated, the presence of the stern rake section in the vessel of the invention—more particularly, force exerted on the stern rake section by water flowing past the downward-angled stern rake section—provides an upward force, as indicated by arrow H, at the stern of the vessel that counteracts to a degree the natural tendency of an accelerating boat to squat in the rear (which occurs because the thrust of the propeller is exerted below the surface of the water). As illustrated by FIG. 9(*b*), a boat lacking the stern rake section 16 would tend to squat much more than the boat of the invention, because the upward force exerted by the flowing water would not be concentrated near the transom, as in the boat of the invention. As noted above, the laterally outward portions of the stern rake section 16 extend aft beyond line 16*a* (FIG. 6) at which the stern rake section meets the "motor notch" portion of the transom. Consequently, upward force indicated by arrow H is at least partially exerted aft of line 16*a*, effectively pivoting the boat about line 16*a*, so that the lift indicated by arrow H is rendered most effective.

Figure 10:
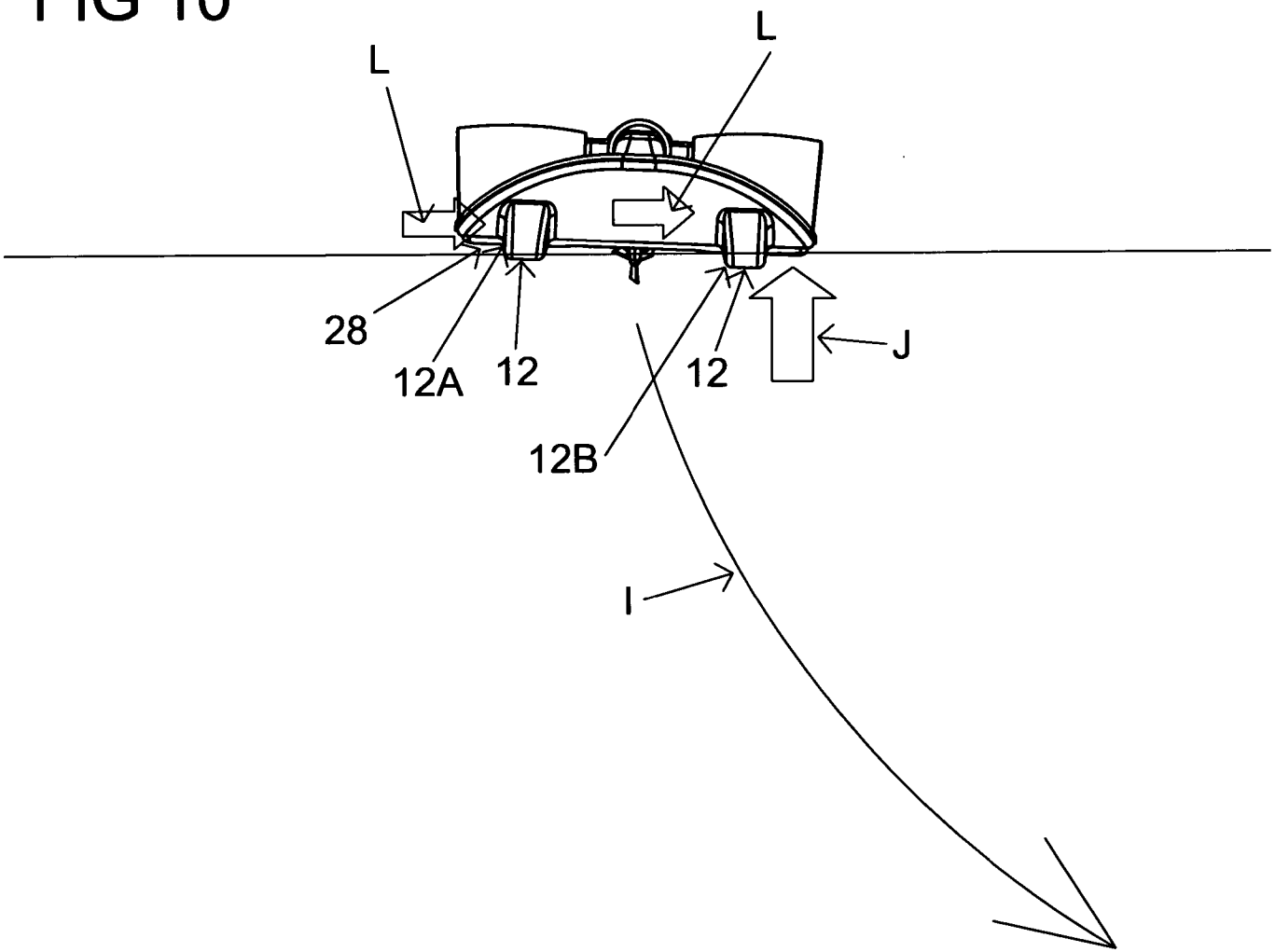

FIG. 10 shows a bow-on view of the boat, as if turning to port, as indicated by arrow I. Turning to port as illustrated is initiated by pivoting of motor M, in the usual manner, which causes the stern of the boat to be propelled to starboard with respect to the bow, pivoting the boat. According to the invention, the near-vertical sides of the pontoons 12 toward the outside of the turn, that is, outer side 12*a* of the starboard pontoon and inner side 12*b* of the port pontoon, provide vertical reaction surfaces that "bite" into the water. The pontoons thus help the boat to pivot by effectively preventing the bow from slipping freely across the water surface as would tend to occur if the pontoons were not present and the bottom were simply a flat surface.

Stated differently, the vertical surfaces on the pontoons, which as noted are only in the forward portion of the boat, provide resistance to sideways movement of the bow of the boat, so that when pivoting of the motor causes the stern to move to one side, the pontoons, by "biting" into the water, effectively constrain the bow to tend to go straight through the water, helping the boat to turn by urging the bow in the opposite direction from the stern, as indicated by arrows L. It will be appreciated that if the pontoons were full-length they would not have this effect, since they would not be able to exert force only near the bow of the boat.

To encourage this "bite" of the pontoons into the water, the inside corners at which the walls of the pontoons meet the planar central section 10 and upturned bow section 14 should be minimally radiused, that is, should be as "sharp" as possible given manufacturing constraints. The "bite" provided by the surface of the outer sides 12*a* is further effectuated by the pontoons being set back substantially from the sides of the boat. It will be appreciated that if the pontoon side surfaces were merely a downward extension of the laterally outermost edge of the hull, the water would not be confined in longitudinally-extending spaces 28 formed between the outer pontoon side 12*a* and the undersurface of the hull, but would simply flow upwardly, providing little resistance to sideward movement of the pontoon through the water, thus failing to assist in causing the boat to turn in response to pivoting of the motor. The fact that the pontoons 12 are inset from the sides of the boat also provides bouyancy to the inside of the turn, as indicated by arrow J, keeping the boat relatively flat while turning.

Figure 11:
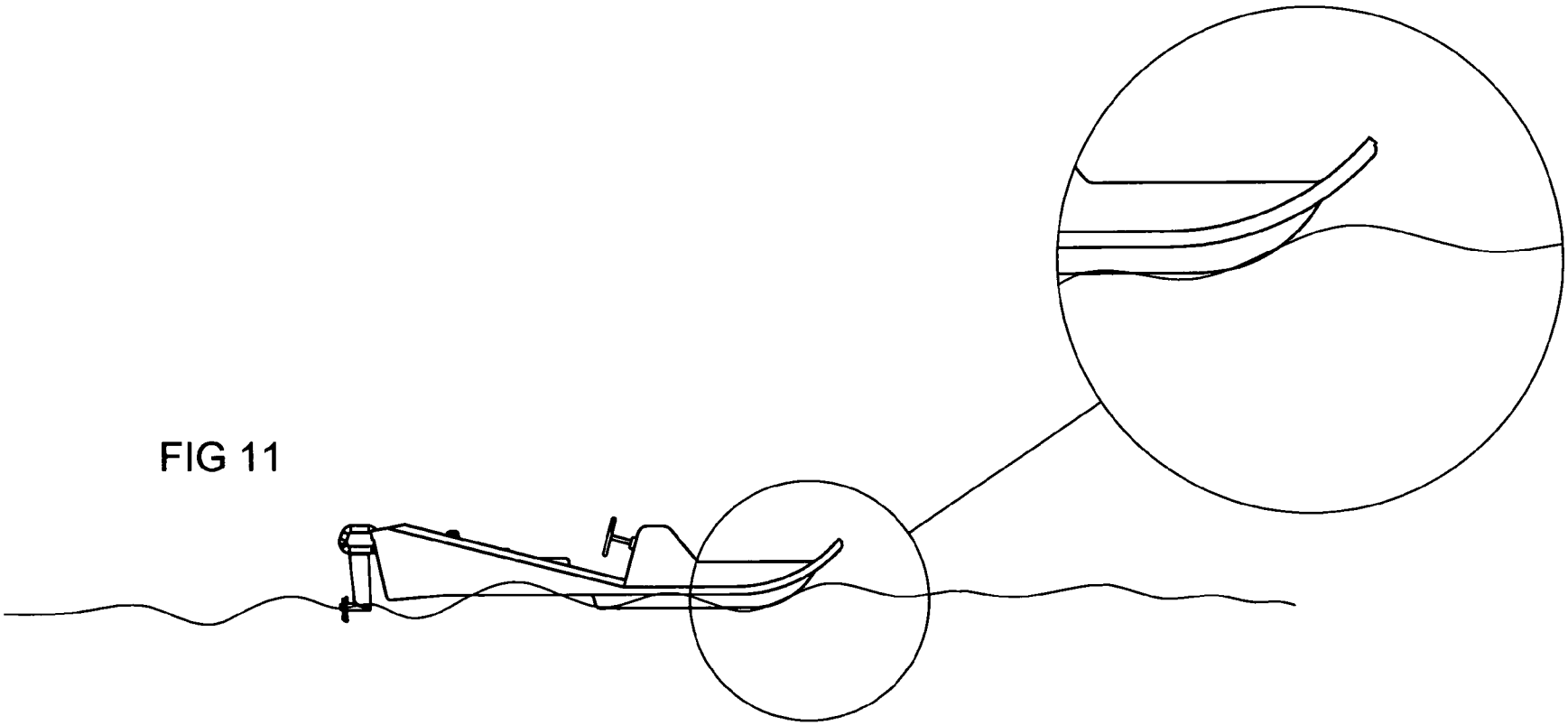

FIG. 11, which comprises an enlarged portion, simply illustrates the manner in which the upturned bow section 14, with the pontoons curving up accordingly, provides bouyancy to lift the bow over waves, providing a drier ride than otherwise.

Figure 12:
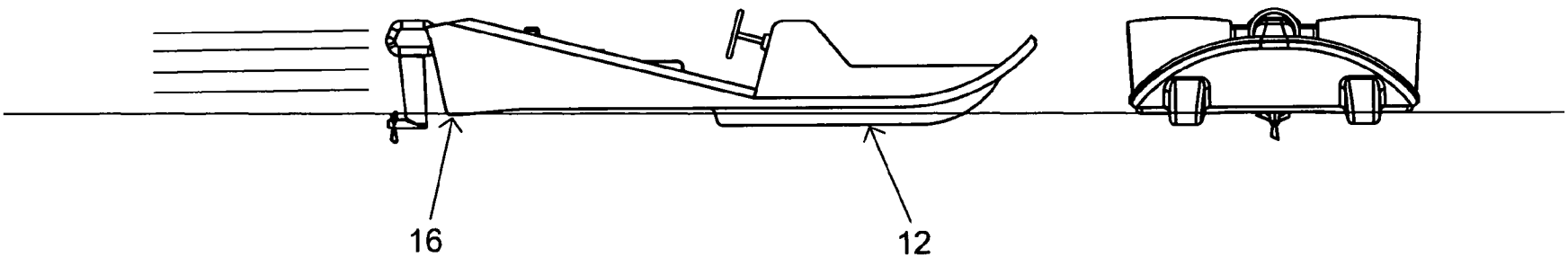

FIG. 12 shows the attitude of the boat of the invention at speed. As illustrated, it planes over the surface of the water, with only the lowermost portions of the pontoons 12 and the after edge of the stern rake section 16 contacting the water surface. This has the effect of reducing the wetted surface to a minimum, so that the boat can reach high speeds while being driven by a relatively small outboard motor. A prototype, not conforming to the dimensions of the preferred embodiment discussed in detail herein but of similar proportions, weighing approximately 650 lbs with operator and passenger, can be driven to 35 knots by a 25 horsepower motor M.

Figure 13:
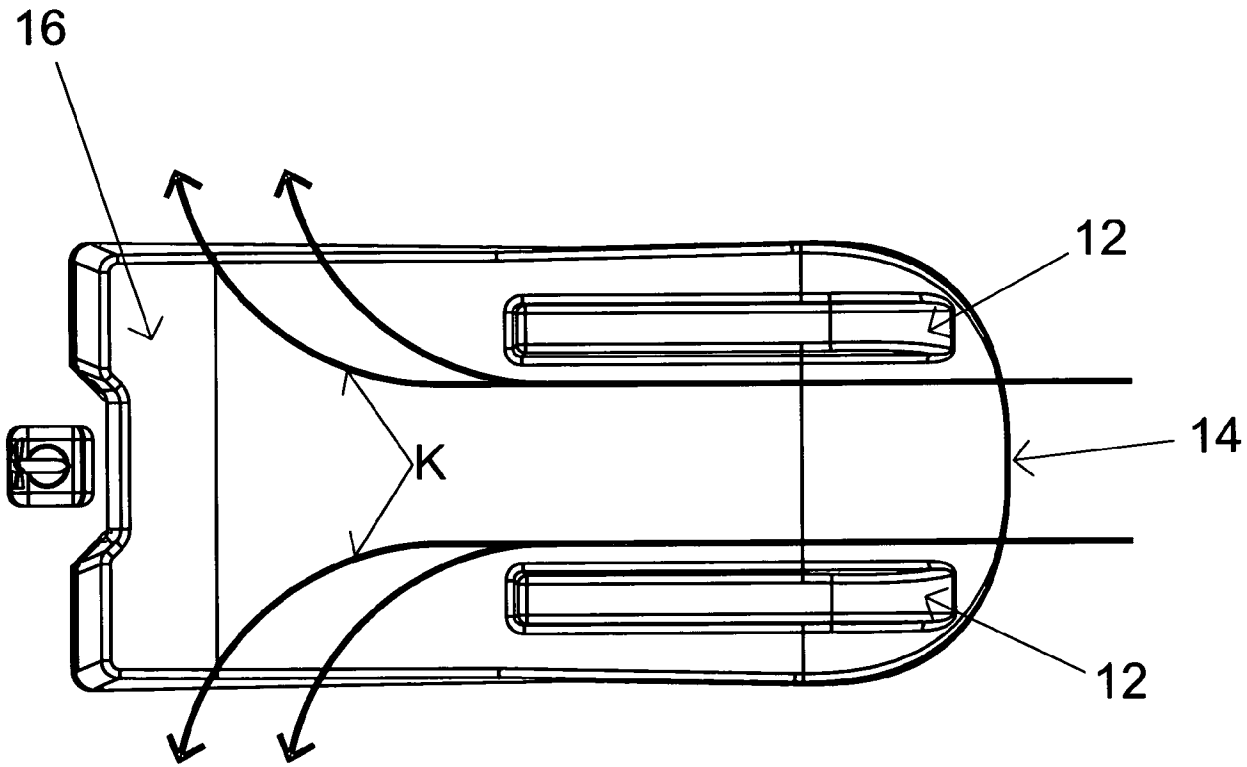

FIG. 13 shows a view from the underside of the boat illustrating airflow at speed. As indicated by arrows K, air drawn in under upturned bow section 14 is forced to flow between pontoons 12, as the lower extremities of pontoons 12 are below the surface of the water. When the airflow reaches the after ends of the pontoons 12 it is exhausted out the sides of the boat, as illustrated; the air cannot simply flow under the boat from front to rear, because the after edge of stern rake section 16 is also submerged. The overall effect is to provide an air cushion under the forward portion of the boat, between the pontoons, further improving the ride.

Combining the functional features shown in FIGS. 12 and 13, it will be appreciated that when the boat of the invention is moving over the water at a speed in excess of a minimum planing speed, air is entrained between the pontoons, providing aerodynamic lift to the forward portion of the boat, and is exhausted to either side of the boat at the after end of the pontoons, while the generally planar stern rake section provides hydrodynamic lift to the after portion of the boat, whereby the boat assumes a balanced planing attitude.

Those of skill in the art will recognize that numerous modifications and improvements can be made to the vessel design of the invention without departure from its spirit and scope as set forth in the attached claims. In particular, while sufficient dimensions and angular relationships have been provided to allow practice of a preferred embodiment of the invention, it is to be clearly understood that the invention is not to be limited thereto. In general it is believed that all of the dimensions given can be varied by as much as 15% in either direction without interfering with successful functioning of the boat in accordance with the principles described. The angular relationships specified can similarly vary substantially from the preferred values given.

Therefore, the invention should not be limited by the above exemplary disclosure, but only by the following claims.

What is claimed is:

1. A boat intended to be powered by an outboard motor, said boat being symmetric about a longitudinal centerline, said boat comprising a hull, a transom, and a superstructure, said hull defining an undersurface meeting said transom of said boat at its stern, said undersurface comprising:

a generally planar central portion having generally parallel side edges, an upturned bow section, mirror-imaged longitudinally-extending port and starboard pontoons disposed on either side of said centerline of said hull, spaced inwardly from said generally parallel edges of said central portion by at least about 10% of the beam of the hull, said pontoons being disposed in a forward portion of said hull and extending downwardly therefrom, said pontoons having a generally uniform transverse crosssectional shape from front to rear, and having at least downwardly-depending outer side walls that are approximately perpendicular to the water surface and parallel to the centerline, the forward portions of said pontoons curving upwardly so as to conform to said upturned bow section of the undersurface of said hull, and a stern rake section comprising a generally planar surface commencing at a transverse line forward of said transom and extending downwardly, so as to form a non-zero angle with respect to the generally planar central portion of said undersurface of said hull, and ending at said transom.

2. The boat of claim 1, wherein said upturned bow section of the undersurface forms a section of a cylinder centered about an axis transverse to said centerline of said boat.

3. The boat of claim 2, wherein forward port and starboard edges of said upturned bow section are broadly curved in plan as well.

4. The boat of claim 3, wherein said forward port and starboard edges of said upturned bow section define sections of cylinders centered on axes perpendicular to said generally planar center section of said undersurface of said hull.

5. The boat of claim 1, wherein said pontoons each have substantially straight parallel downwardly-depending side walls, so as to define parallel-sided structures.

6. The boat of claim 5, wherein said pontoons are wider at their intersections with said generally planar center section and said upturned bow section than at their lower extremities.

7. The boat of claim 6, wherein the inner side walls of said pontoons meet the generally planar center section and said upturned bow section at an angle, measured in a plane transverse to said centerline, of approximately 105 degrees.

8. The boat of claim 6, wherein the outer side walls of said pontoons meet the generally planar center section and said upturned bow section at an angle, measured in a plane transverse to said centerline, of approximately 95 degrees.

9. The boat of claim 1, where downward corners are formed where said pontoons meet the planar central portion and upturned bow portion of the undersurface of the hull, said downward corners being minimally radiused.

10. The boat of claim 8, wherein after ends of said pontoons form an angle of approximately 105 degrees with respect to the plane of said planar central portion of said undersurface of said hull.

11. The boat of claim 1, wherein said upturned bow section of the undersurface forms a section of a cylinder centered about an axis transverse to said centerline of said boat, wherein forward port and starboard edges of said upturned bow section are broadly curved in plan as well, and wherein said pontoons extend up the undersurface of said bow section such that the forward ends of the pontoons terminate in close proximity to the outer edge of said upturned bow section.

12. The boat of claim 1, wherein if a longitudinal dimension A of said boat is measured between the forward ends of the pontoons and the aftermost portion of said transom, said transverse line at which said stern rake section commences is approximately 16% of A forward of the lower extremity of said transom.

13. The boat of claim 12, wherein the overall length of said pontoons is approximately 50% of A.

14. The boat of claim 1, wherein said transom comprises generally planar port and starboard laterally outer portions, and a central motor-receiving portion that is indented forwardly of said port and starboard outer portions, said generally planar stern rake section terminating at the lower extremity of said port and starboard outer portions and said central indented motor-receiving section.

15. The boat of claim 14, wherein the angle made by said generally planar port and starboard outer portions of said transom with respect to a plane perpendicular to said generally planar undersurface of said hull is approximately 12 degrees.

16. The boat of claim 14, wherein the angle made by said central motor-receiving portion of said transom with respect to a plane perpendicular to said generally planar central portion of said undersurface of said hull is approximately 7 degrees.

17. The boat of claim 1, wherein the non-zero angle made by said generally planar stern rake section of said undersurface of said hull with respect to the generally planar central portion thereof is at least about two degrees.

18. The boat of claim 1, wherein said superstructure comprises a central helm station and flotation compartments on either side of said helm station.

19. The boat of claim 18, wherein said helm station is located longitudinally with respect to the undersurface of said hull such that the weight of an operator, in combination with the buoyancy of the boat, and with aerodynamic and hydrodynamic forces occasioned by movement of the boat over the water, causes the boat to assume different desired attitudes with respect to the surface of the water at rest, at low speeds, and at high speeds.

20. The boat of claim 1, wherein when said boat is moving over the water at a speed in excess of a minimum planing speed air is entrained between said pontoons, providing aerodynamic lift to the forward portion of the boat, and is exhausted to either side of the boat at the after end of said pontoons, while said generally planar stern rake section provides hydrodynamic lift to the after portion of the boat, whereby the boat assumes a balanced planing attitude, in which the boat is supported with respect to the surface of the water on the pontoons and the generally planar stern rake section.

21. The boat of claim 1, wherein downwardly-extending side surfaces of said pontoons provide lateral surface area such that the bow of the boat tends to go straight, assisting the boat in turning in response to pivoting of the motor.

* * * * *